United States Patent [19]

Kim

[11] Patent Number: 4,532,673

[45] Date of Patent: Aug. 6, 1985

[54] PIVOT MECHANISM FOR MULTIPLE AXES OPENING WINDOW OR CLOSURE

[76] Inventor: Sam K. Kim, 2516 W. Pratt Blvd., Chicago, Ill. 60645

[21] Appl. No.: 520,542

[22] Filed: Aug. 5, 1983

[51] Int. Cl.[3] ..... E05D 15/524

[52] U.S. Cl. ..... 16/233; 16/230; 16/368; 49/192

[58] Field of Search ..... 16/229, 230, 231, 232, 16/233, 366, 368, DIG. 23; 49/192

[56] References Cited

U.S. PATENT DOCUMENTS 3,654,663 4/1972 Algotsson ..... 16/230

FOREIGN PATENT DOCUMENTS 1063930 8/1959 Fed. Rep. of Germany ..... 16/230
1068583 11/1959 Fed. Rep. of Germany ..... 16/230
1087044 8/1960 Fed. Rep. of Germany ..... 49/192
633598 2/1962 Italy ..... 49/192

*Primary Examiner*—Fred A. Silverberg
*Attorney, Agent, or Firm*—Dillis V. Allen

[57] ABSTRACT

An opening pivot mechanism for a window or any type of closure that permits the closure to be opened in three directions from a single operator that includes three actuator rods with integral cylindrical bosses that define two pivot pins on each of three axes for slotted hinges carried by the closure. The actuator rods are simultaneously reciprocated by the operator through a series of links to position one of the rods with its pivot pins in their associated hinges thus defining the selected pivot axis, and to position at the same time reduced portions on the other two actuator rods in the remaining hinges so these rods can pass through the slots in their hinges during opening movement of the closure.

11 Claims, 11 Drawing Figures

PIVOT MECHANISM FOR MULTIPLE AXES OPENING WINDOW OR CLOSURE

BACKGROUND OF THE INVENTION AND PRIOR ART STATEMENT

Multiple axes opening windows and other types of closures have found a considerable degree of success in Europe but to date they have found only limited commercialization in the United States particularly due to the rather complex operating mechanism required to permit the closure to be selectively opened about more than one axis.

There have been provided in the past operating mechanisms for opening windows and doors about all four axes, i.e. the upper horizontal axis, the lower horizontal axis, the left vertical axis and the right vertical axis. Such a mechanism is shown in the Schindlauer U.S. Pat. No. 3,690,035. Schindlauer provides two hinges on each of the four sides of his window frame making a total of eight hinges and he has eight solenoid operated plungers that are selectively insertable into these hinges to effect window opening about each of the four axes. No control circuit for operating these solenoids is shown in the Schindlauer patent.

The Müller U.S. Pat. No. 3,434,238 discloses hinges defined at the left and right vertical axes and lower horizontal axis that cooperate with axially movable pivot pins 16 and 17. The pins 16 on the left vertical axis are controlled by operator member 18 and the actuator rod 8 while the pins 16 and 17 respectively on the right vertical axis and the lower horizontal axis are controlled by pivoting operator 21 (see also FIGS. 9 and 10). The function of lever 21 as seen in FIG. 8 is inadequately shown and described, as to whether it is intended to control both the lower horizontal pins 17 and the right vertical pins 16.

The Thams U.S. Pat. No. 3,308,579 shows a rack and pinion mechanism for actuating a pivot and lock mechanism commonly about perpendicular axes and it appears that lever 17 only controls hinge pivot 7 and interlock connection 22, 23 as seen in FIG. 6.

The Frank U.S. Pat. No. 2,866,635 shows an operating mechanism for a window that permits the window to be opened about either a lower horizontal axis or a right vertical axis and this mechanism requires multiple operating members 7 and 37 to achieve the selective opening function. The Abbott et al U.S. Pat. No. 531,244 shows a mechanism for swinging a window about either a right vertical axis or a left vertical axis, but like the Frank mechanism Abbott et al require more than one operator 16 to effect this result. The Keating U.S. Pat. No. 382,707 and the Bast U.S. Pat. No. 1,160,366 also show multiple opening axes closures but in these devices the hinge elements must be individually manually operated to effect the desired result.

Thus, the prior art while suggesting a variety of mechanisms for achieving selective axes opening pivotal windows and doors, has failed to suggest a simple mechanism for achieving this selective opening pivotal movement from a single operating device.

It is the primary object of the present invention to ameliorate the problems in the above discussed prior multiple axes opening pivot devices.

SUMMARY OF THE PRESENT INVENTION

In accordance with the present invention an opening pivot mechanism is provided for a window or any type of closure that permits the closure to be opened in three directions from a single, easily manually manipulated operator member. This operator drives three actuator rods in reciprocation each along one of the pivotal axes of the casement all mounted in and concealed within a stationary window frame. The casement has two hinges projecting from each of its left and right stiles and bottom rail and these hinges have slotted cylindrical portions that slidably receive the actuating rods. The actuating rods have discrete cylindrical boss portions that define pivot pins when received in the hinges and they also have intermediate reduced tang portions that when positioned within the hinge can pass through the slots in the hinge so the casement or sash can be opened.

The operator member consists of a plate pivotable about a horizontal axis at one of the lower corners of the exemplary window frame and is movable from a neutral position where the window sash may be pivoted about a lower horizontal axis to a counterclockwise position where the window sash is pivotal about a right vertical axis, to a clockwise position where the window sash is pivotal about a left vertical axis. Each of the actuator rods is mounted in stationary support brackets within a hollow channel inside the stationary window frame. The right vertical actuator rod is connected directly to the pivotal operator by a short link as is the lower horizontal actuator rod. The lower horizontal actuator rod in turn drives the left vertical actuator rod through a pivoting plate and links similar to the operator plate and its link. The cylindrical bosses that define the pivot pins and the intermediate reduced tang sections are positioned such that in the neutral position of the operator plate the boss portions on the lower horizontal actuator rod are in their associated hinges while the left and right vertical actuator rods have their reduced tang sections within the hinges and hence they may pass through the associated hinge slots and in this position the window sash may pivot about the lower horizontal axis defined by the lower horizontal actuator rod. In the counterclockwise position of the pivotal operator plate, the cylindrical bosses on the right actuator rod enter the right window sash hinges while reduced tang portions on the lower horizontal actuator rod and the left vertical actuator rod enter their associated hinges permitting opening movement of the window sash about a right vertical axis. In the counterclockwise position of the operator plate, the cylindrical portions on the left vertical actuator rod enter the associated left sash hinges while the reduced tang portions on the lower actuator rod and the right actuator rod enter their associated hinges permitting opening movement of the window sash about a left vertical axis extending through the left actuator rod.

Another feature of the present invention is the provision of a locking mechanism apart from the pivotal operating plate that prevents inadvertent movement of the actuating rods when the window is open. This of course eliminates the possibility that someone may inadvertently disengage the pivot pins that are in the hinge elements when the window is open which would of course leave the window sash unsupported. Toward this end a detent mechanism is provided in one or both of the hinges associated with each of the three actuator rods. The detent mechanism includes a spring biased plunger in the hinge that is biased into engagement with the periphery of the actuator bar. A transversely curved recess or cut out is provided in the periphery of the boss portion or pin portion of each of the actuator rods that is aligned with the detent when the pin is in the hinge. This recess is angularly located on the pin so that the detent snaps into the cut-out or recess during opening movement of the sash and is cammed out of the recess upon closing movement of the sash.

The detent mechanism does not however prevent window removal when desired. Toward this end the recesses in the hinge pins are spaced sufficiently from the detent mechanism in the closed position of the window such that the window sash may be pivoted to an intermediate position where the idle hinges are disengaged from their associated hinge pins and the detent mechanisms on the active pivot axis are not quite engaged into the associated cut-outs in the seated hinge pins. With the window in this intermediate position, the operator may rotate the operator plate to either of the two other positions which will reciprocate the active actuator rod to a position where its reduced tangs are in the active hinges permitting the entire window sash to be removed from the frame.

DETAILED DESCRIPTION OF THE PREFERRED EMBODIMENT

Figure 1:
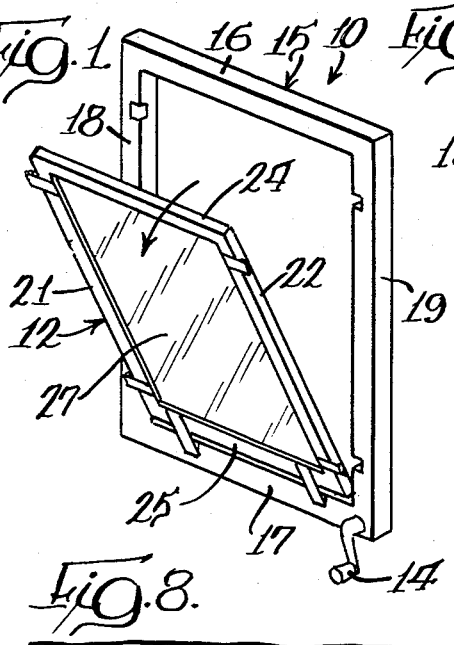
FIG. 1 is a perspective view of a multiple axes opening window according to the present invention with the window sash opening about a lower horizontal axis.
Figure 2:
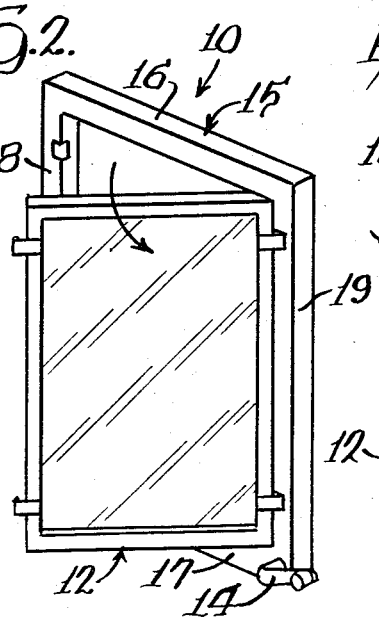
FIG. 2 is a perspective view of a multiple axes opening window according to the present invention with the window sash opening about a right vertical axis.
Figure 3:
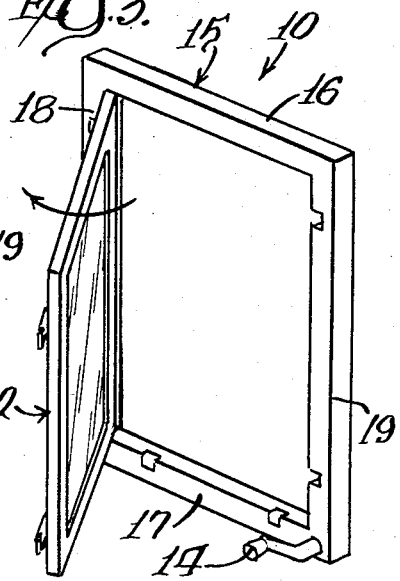
FIG. 3 is a perspective view of a multiple axes opening window according to the present invention with the window sash opening about a left horizontal axis.
Figure 8:
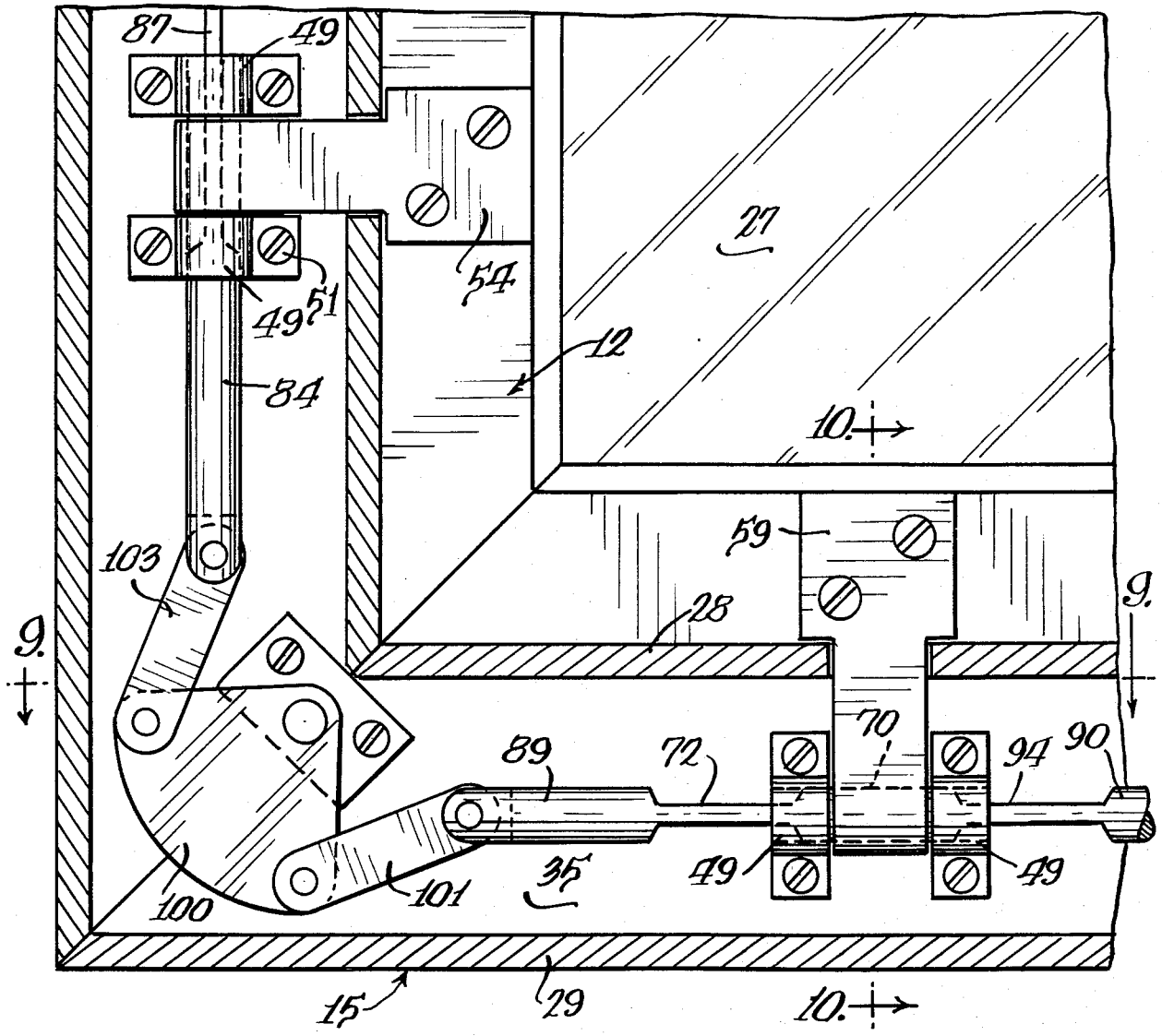
FIG. 8 is a longitudinal fragmentary section illustrating the pivot plate for transferring reciprocating motion from the lower horizontal actuator rod to the left vertical actuator rod.

Referring to the drawings and initially to FIGS. 1 to 3, the present window assembly 10 is shown serially in perspective form in FIGS. 1 to 3 with its sash 12 (a) opening about a lower horizontal axis with its operating handle 14 in a center position illustrated in FIG. 1, (b) opening about a right vertical axis with its control handle 14 in a counterclockwise position illustrated in FIG. 2 and (c) opening about a left vertical axis with its handle 14 in a rotated from its center position to clockwise position illustrated in FIG. 3. The window assembly 10 generally includes a stationary hollow frame assembly 15 including a top frame member 16, bottom frame member 17, interconnected by a left vertical frame member 18 and a right vertical frame member 19. The multiple axes opening window sash 12 includes a left vertical stile 21 and a right vertical stile 22 interconnected by an upper rail 24 and a lower rail 25 which together frame a central glass pane 27 as seen more clearly in FIGS. 4 and 5, the hollow frame assembly 15 and particularly each of the frame members 16, 17, 18 and 19 includes an inner header 28 and an outer header 29 interconnected by a vertically orientated support 31 and a facia strip 32 that has recesses 33 therein to permit opening movement for the sash and clearance for the hinges. The frame strips 28, 29, 31 and 32 are fastened to a 2×4 frame member 35 that extends completely around and within the frame 15.

The 2×4 frame 35 supports the frame supported portion of the pivot mechanism 36.

Figure 5:
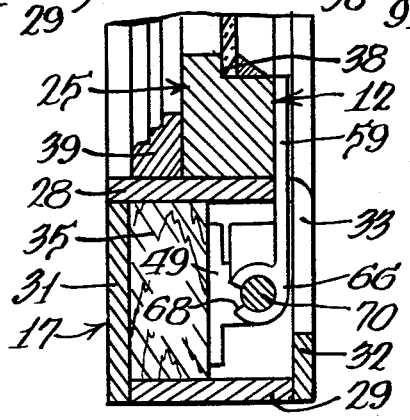
FIG. 5 is a fragmentary section taken generally along line 5—5 of FIG. 4 illustrating one actuator rod, support bracket and hinge mounting arrangement, which is exemplary for all of the hinges illustrated.

As seen in FIG. 5, the lower sash stile 27 has an upper shoulder 38 for receiving glass pane 27, and the outer face of the rail 27 has a molding strip 39 affixed thereto.

Figure 4:
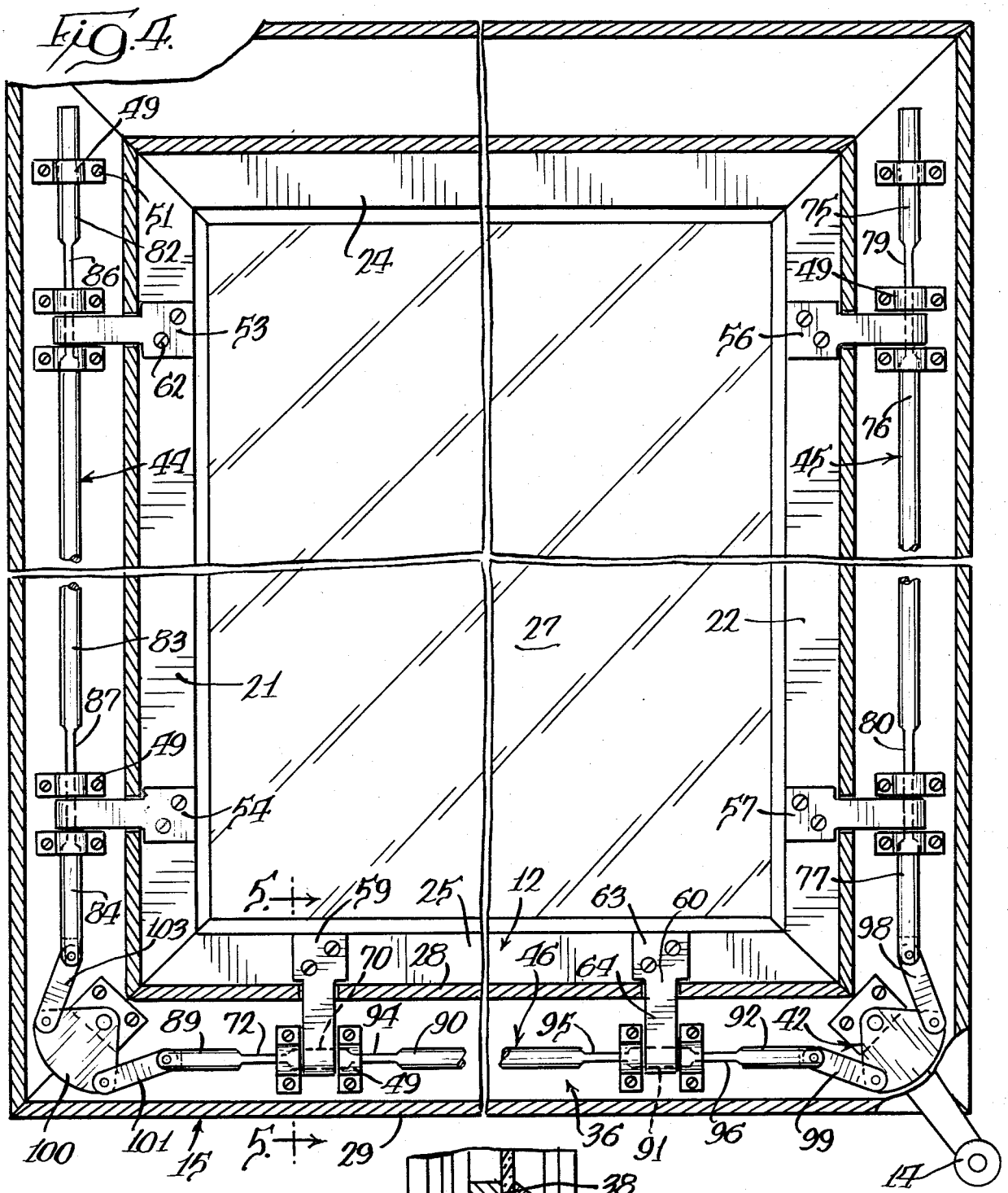
FIG. 4 is an enlarged longitudinal section through the window assembly illustrated in FIGS. 1 to 3 with the pivot mechanism illustrated in its center position that corresponds to the window sash movement illustrated in FIG. 1.

As seen in FIG. 4, the present three axes pivot mechanism 36 is seen to generally include a pivotable operating plate 42 that pivots from its center position illustrated in FIG. 4 in both directions to position a left actuator rod 44, a right actuator rod 45 and a lower horizontal actuator rod 46. The axes of the actuator rods 44, 45 and 46 define the three axes for pivotal movement of the sash 12. The actuator rods 44, 45 and 46 are mounted for reciprocating movement within the hollow window frame 15 by a plurality of U-shaped brackets 49 all identical in construction that are complementary with the larger diameter portions of the actuator rods to provide a smooth sliding fit therebetween. Each of the brackets 49 is fastened to the 2×4 frame header 35 by fasteners 51 which may for example be wood screws.

As seen in FIGS. 4 and 5 the stiles and bottom rail of the sash 12 each carry two hinges including hinges 53 and 54 fixed to the left stile, hinges 56 and 57 fixed to the right stile and hinges 59 and 60 fixed to the bottom rail. Hinges 53, 54, 56, 57, 59 and 60 are fixed to the inside surface of the stiles and bottom rail by suitable wood screws 62. Each of the hinges is identical and includes an enlarged mounting portion 63 having apertures for receiving wood screws 62, a tang portion 64 (see hinge 60 in FIG. 4) and a segmented cylindrical portion 66 having a longitudinal slot 68 completely therethrough.

Figure 7:
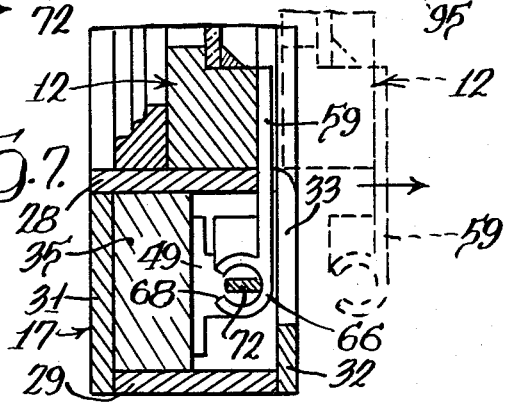
FIG. 7 is a fragmentary section taken generally along line 7—7 of FIG. 6 showing the reduced tang portion of the associated actuator rod aligned in the hinge permitting opening movement of the sash as illustrated in dotted lines in this figure.
Figure 9:
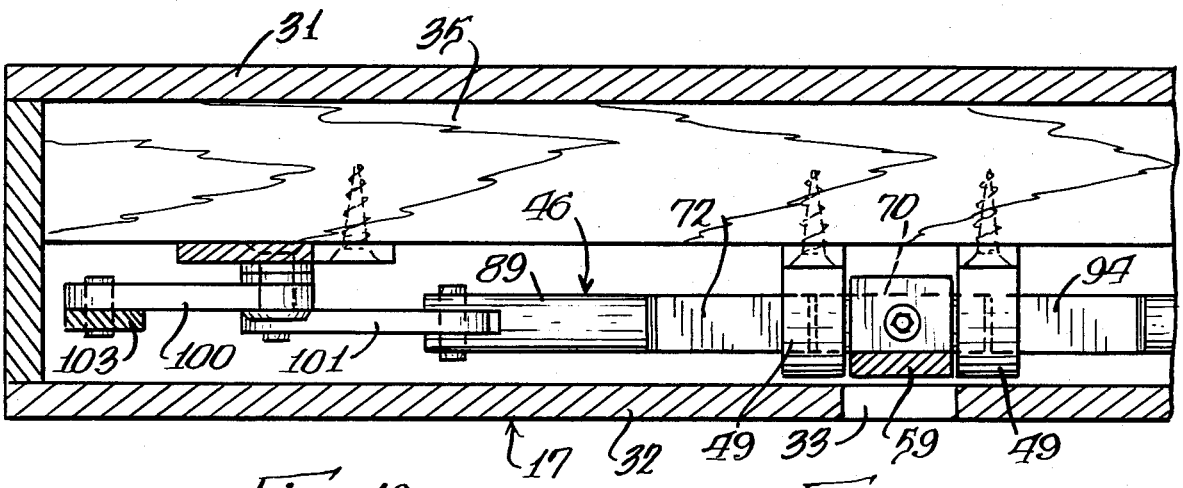
FIG. 9 is a fragmentary section taken generally along line 9—9 of FIG. 6 showing the pivotal operator plate and its connection to the lower horizontal actuator rod.

While the actuator rods 44, 45 and 46 are not identical in configuration, the crosssection and manner of operation of each are identical and each is cylindrical along its length with a plurality of complete cylindrical bosses that define pivot pins when positioned in one of the hinges 53, 54, 56, 57, 59 and 60, and a plurality of intermediate reduced tang portions that when positioned in one of the hinges permits the hinge to escape from the actuator rod (see FIGS. 5 and 7).

As seen in FIGS. 4 and 5, cylindrical boss portion 70 on actuator rod 46 has an outer diameter equalling the inner diameter of the segmented cylindrical portion 66 on hinge 59, and this relationship and configuration are the same for the boss portions on each of the actuator rods 44, 45 and 46.

Figure 6:
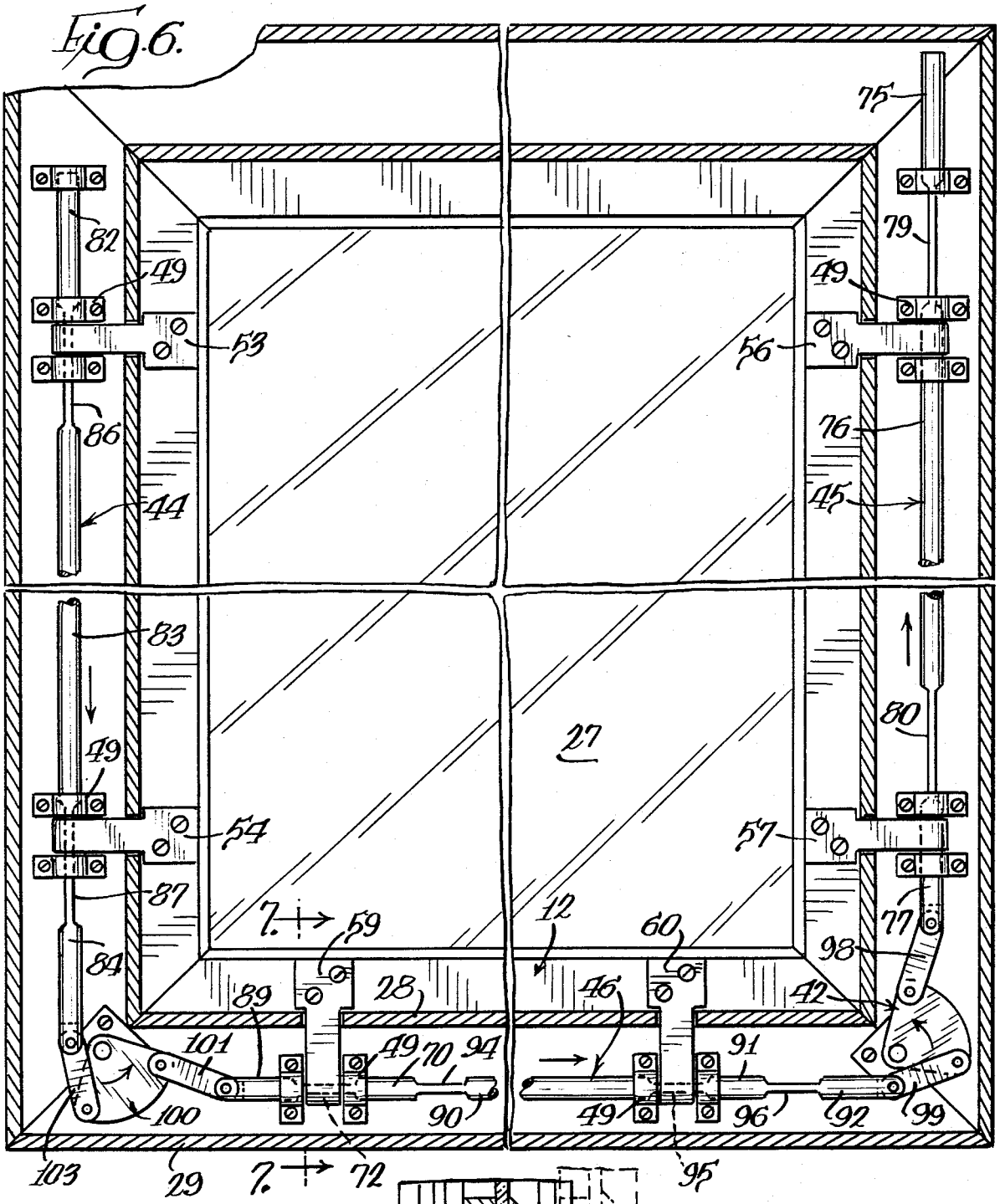
FIG. 6 is a longitudinal mechanism of the entire window assembly similar to FIG. 4 except that the pivot mechanism is in its counterclockwise position corresponding to the window sash opening movement illustrated in FIG. 2.

As seen in FIGS. 6 and 7, the actuator rod 46 has an intermediate reduced tang portion 72 with a thickness less than the slot 68 in the segmented cylindrical portion 32 of hinge 59 so that in this position of the actuator rod 46, hinge 59 can escape from the actuator rod 72 as the sash 12 pivots about either the left vertical axis or the right vertical axis and this relationship is the same for the tang portions on all the activator ends 44, 45 and 46.

Viewing FIG. 4, the right vertical actuator rod has boss portions 75, 76 and 77 separated by intermediate reduced tang portions 79 and 80. Left vertical actuator rod 44 has cylindrical boss portions 82, 83 and 84 separated by reduced tang portions 86 and 87. Lower horizontal actuator rod 46 has cylindrical boss portions 89, 70, 90, 91 and 92 separated by reduced tang portions 93, 94, 95 and 96. The spacing between the cylindrical boss portions and the tang portions on the actuator rods 44, 45 and 46 determines the logic of the pivot mechanism 36 for selecting the desired pivot axis for sash 12.

The pivotal operator plate 42, illustrated in FIG. 4 in its central position, is connected to actuator rod 45 by a short length 98 pivotally connected at one end to rod 45 and at its other end to plate 42; and plate 42 is connected to actuator rod 46 by link 99 identical to link 98 pivotally connected at one end to rod 46 and at its other end to plate 42. Reciprocating motion of actuator rod 46 is imparted to actuator rod 44 by a pivot plate 100 similar in configuration to operator plate 42, and plate 100 is drivingly connected to actuator rod 46 by link 101 pivotally connected at one end to rod 46 and at its other end to plate 100; and plate 100 is drivingly connected to actuator rod 44 by link 103 identical to link 101 pivotally connected at one end to rod 44 and at its other end to plate 100.

With the operator plate 42 in its center position illustrated in FIG. 4, the pivot mechanism 36 is positioned to permit opening movement of the sash 12 about the lower horizontal axis. In this position the lower actuator rod pivot bosses 70 and 91 are positioned within the hinges 59 and 60 to define the pivots for the sash while reduced tang portions 86 and 87 on the left vertical rod 44 are positioned within their associated hinges 53 and 54 and reduced tang portions 79 and 80 on right actuator rod 45 are positioned within their associated hinges 56 and 57 permitting hinges 53, 54, 56 and 57 to escape from the actuator rods 44 and 45 as the sash 12 pivots about the axis of the lower actuator rod 46.

Upon counterclockwise rotation of the operator pivot plate 42 by manual manipulation of handle 14 to its position illustrated in FIG. 6, the cylindrical bosses 77 and 76 on actuator rod 45 enter hinges 57 and 56 respectively defining a right vertical pivot axis for the sash 12 while reduced tang portions 86 and 87 remain in hinges 53 and 54 even though the left vertical actuator rod 44 is shifted downwardly because of the length of the reduced tang portions 86 and 87, and reduced tang portions 93 and 95 on the lower actuator rod 46 enter hinges 59 and 60 so that the hinges 53, 54, 59 and 60 are free from the actuator rods 44 and 46 permitting sash 12 to pivot open about a right vertical axis.

Upon rotation of handle 14 and plate 42 in a clockwise direction from its position illustrated in FIG. 4 the cylindrical bosses 83 and 84 on left vertical actuator rod 44 enter hinges 53 and 54 defining a left vertical pivot for sash 12, while reduced tang portions 79 and 80 on right vertical actuator rod 45 are received in hinges 56 and 57, and reduced tang portions 94 and 96 on lower actuator rod 46 enter hinges 59 and 60 permitting hinges 56, 57, 59 and 60 to escape from actuator rods 45 and 46 respectively, permitting the sash 12 to open about the left vertical axis defined by actuator rod 44.

Figure 10:
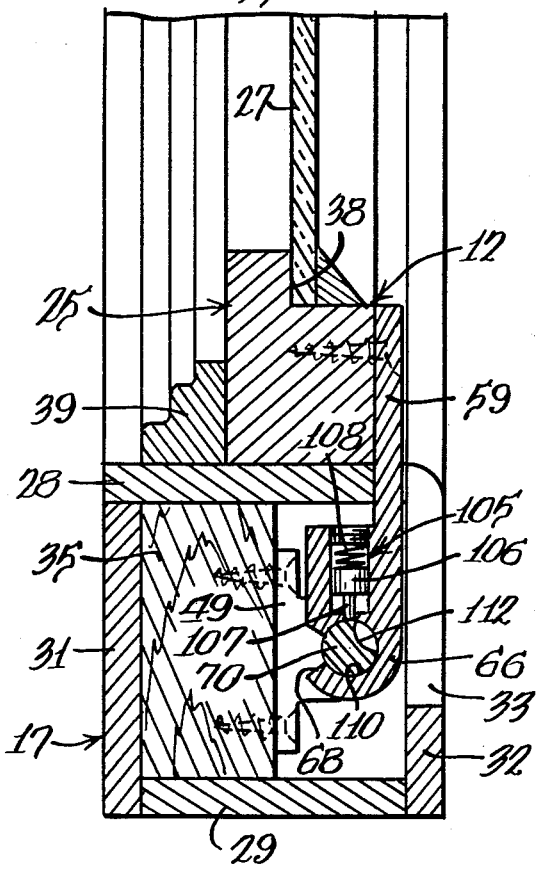
FIG. 10 is a fragmentary section taken generally along line 10—10 of FIG. 8 illustrating the automatic actuator rod locking mechanism.
Figure 11:
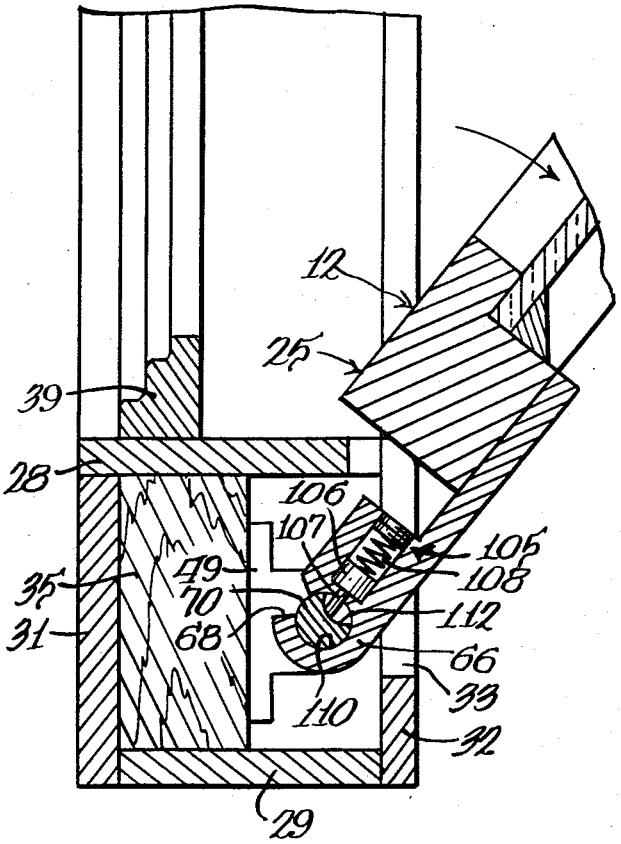
FIG. 11 is a fragmentary section similar to FIG. 10 with the sash in its open position.

As seen in FIGS. 10 and 11, a detent mechanism 105 is provided for locking the actuator rod from movement when the window or sash is one of its open positions. A detent mechanism 105 is provided on each of the hinges 53, 54, 56, 57, 59 and 60. Detent mechanism 105 includes a plunger 106 having a stem portion 107 biased by a small coil compression spring 108 into cylindrical bore 110 within hinge cylindrical portion 32. Each of the actuator rod cylindrical portions 83, 84, 70, 91, 76 and 77 has an arcuate recess or slot 112 in the surface thereof that is axially aligned with detent stem portion 107 when the cylindrical boss is positioned within its associated hinge. As seen in FIG. 10, recess 112 is angularly positioned from plunger 107 when the sash 12 is in its closed position illustrated. However as the window sash 12 is opened, as seen in FIG. 12, spring 108 snaps plunger 106 and stem 107 downwardly engaging the plunger into recess 112. Recess 112 has an axial width only slightly greater than plunger stem 107 thereby locking the pivot actuator as well as the two inactive actuators from movement and thereby preventing the inadvertent disassembly of the sash from the window.

The recess 112 has an arcuate configuration in crossection so that upon closing movement of sash 12 from its open position illustrated in FIG. 11, the lower surface of the recess 112 acts as a cam, camming the plunger stem portion 107 and plunger 106 upwardly against the bias of spring 108 back to its position illustrated in FIG. 10 where the plunger stem 107 is in engagement with the outer diameter of the cylindrical boss portion of the actuator rod.

The recess 112 as viewed in FIG. 10 is angularly positioned in a clockwise direction away from a vertical line extending through the axis of the actuator rod, so that the sash may be opened slightly without the plunger stem portion 107 snapping into recess 112. In this position the hinges on the other two sides of the sash are sufficiently away from their associated actuator rods so that upon shifting the active actuator rod to a position aligning the tangs on that rod in their associated hinges, the operator may remove the entire window sash 12 from its frame 16.

I claim:

1. In a hinge and locking mechanism for a generally rectangular closure member that may be opened by pivotal movement about at least two axes, a stationary generally rectangular frame member surrounding and supporting the closure member, hinge means on each of the axes mounted on one of the members, the improvement comprising; two spaced hinges on each of said axes on one of said members, two spaced pivot pins on each of the axes mounted on the other of said members selectively positionable in each of the hinges to define pivot axes for the closure member when the pins are in the hinges, and a common operator for all of the pins, said pivot pins on each axis being formed integrally and coaxially with an actuator rod connected to the common operator, said pivot pins being shiftable axially to a position freeing the hinges from the pivot pins without shifting the closure member laterally in the plane of the closure member.

2. In a hinge and locking mechanism for a generally rectangular closure member that may be opened by pivotal movement about at least two axes, a stationary generally rectangular frame member surrounding and supporting the closure member, hinge means on each of the axes mounted on one of the members, as defined in claim 1 wherein the pivot pins and the actuator rods are in one piece.

3. In a hinge and locking mechanism for a generally rectangular closure member that may be opened by pivotal movement about at least two axes, a stationary generally rectangular frame member surrounding and supporting the closure member, hinge means on each of the axes mounted on one of the members, as defined in claim 1, wherein the pivotal axes are adjacent and perpendicular to one another, the common operator being a pivotal member mounted on the other of said members approximately at the point of intersection of the pivotal axes, said pivot pins each being cylindrical bosses formed integrally on the actuator rods, each of the actuator rods being pivotally connected to the operator.

4. In a hinge and locking mechanism for a generally rectangular closure member in a generally rectangular frame member that is openable about at least three axes each located generally along and parallel to one of the sides of the rectangular closure member, hinge means mounted on one of the members on each of said axes, first, second and third pin means mounted on the other of said members along each of said axes and selectively movable into and out of the hinge means, the improvement comprising; a common operator for the first, second and third pin means and mounted on the other of said members movable to a first position engaging the first pin means into one of the hinge means and disengaging the second and third pin means from other of said hinge means to permit pivotal movement of the closure member about a first of said axes, said common operator being movable to a second position engaging the second pin means into one of the other hinge means and disengaging the first and third pin means from the remaining hinge means to permit pivotal movement of the closure member about a second of said axes, and said common operator being movable to a third position engaging the third pin means in the other of said other hinge means and disengaging the first and second pin means from the remaining hinge means to permit pivotal movement of the closure member about the third of said axes.

5. In a hinge and locking mechanism for a generally rectangular closure member that may be opened by pivotal movement about at least three axes, a stationary generally rectangular frame member surrounding and supporting the closure member, hinge means on each of the axes mounted on one of the members, as defined in claim 4, wherein the operator includes a pivotally mounted member on said other member approximately at the juncture of two of the axes, said three axes being in U-shaped orientation with the connecting axis being the second axis referred to above, said second position of the operator being its center position, said first position of the operator being angularly spaced from the center position in one direction, and said third position of the operator being angularly spaced from the center position in the other direction.

6. In a hinge and locking mechanism for a generally rectangular closure member in a generally rectangular frame member that is openable about at least three axes each located generally along and parallel to one of the sides of the rectangular closure member, hinge means mounted on one of the members on each of said axes, as defined in claim 4, wherein the first, second and third pin means are formed integrally on first, second and third actuator rods each extending along one of said three axes.

7. In a hinge and locking mechanism for a generally rectangular closure member in a generally rectangular frame member that is openable about at least three axes each located generally along and parallel to one of the sides of the rectangular closure member, hinge means mounted on one of the members on each of said axes, as defined in claim 6, wherein the hinge means includes two hinges on each of the three axes mounted on the closure member, each of the actuator rods having two cylindrical bosses thereon that define two pins insertable into the hinges.

8. In a hinge and locking mechanism for a generally rectangular closure member that may be opened by pivotal movement about at least two axes, a stationary generally rectangular frame member surrounding and supporting the closure member, hinge means on each of the axes mounted on one of the members, pin means carried by the other of said members along each of said axes being selectively positionable in the hinge means, and operator means for selectively moving the pin means to permit opening of the closure member about either axes, the improvement comprising; each of said hinge means on each axis including two spaced hinges each having a cylindrical portion with a side slot therein extending longitudinally therethrough, and an actuator rod on each of said axes driven by the operator means extending through the cylindrical portion of each of the hinges, each of said actuator rods having spaced cylindrical bosses and reduced portions adjacent the cylindrical bosses having a width less than the width of the slot in the cylindrical portion of the hinges so that when one of the actuator rods is positioned with said reduced portions in the cylindrical portions the reduced portions may pass through the slots to permit closure member opening without laterally shifting the closure member in the plane of the closure member.

9. In a hinge and locking mechanism for a generally rectangular closure member that may be opened by pivotal movement about at least two axes, a stationary generally rectangular frame member surrounding and supporting the closure member, hinge means on each of the axes mounted on one of the members, pin means carried by the other of said members along each of said axes being selectively positionable in the hinge means, and operator means for selectively engaging the pin means to permit opening of the closure member about either axes, the improvement comprising; means directly engageable with the pin means and separate from the operator member and being responsive to opening movement of the closure member about one of said axes for automatically and positively locking the pin means on said one axis from all axial movement while permitting relative rotational movement between the pin means and the hinge means on said one axis.

10. In a hinge and locking mechanism for a generally rectangular closure member that may be opened by pivotal movement about at least two axes, a stationary generally rectangular frame member surrounding and supporting the closure member, hinge means on each of the axes mounted on one of the members, as defined in claim 9, wherein said means for locking the pin means includes a spring biased detent on each of said hinge means continuously biased into a recess in the pin means.

11. In a hinge and locking mechanism for a generally rectangular closure member that may be opened by pivotal movement about at least two axes, a stationary generally rectangular frame member surrounding and supporting the closure member, as defined in claim 10, wherein the recesses in the pin means have a camming surface for disengaging the associated detent from the recess as the closure member is rotated in a closing direction, and cam means axially adjacent the pin means for moving the detent outwardly as the pin means is inserted into the hinge means.

* * * * *